US005156401A

United States Patent [19]

Hodgkiss

[11] Patent Number: 5,156,401

[45] Date of Patent: Oct. 20, 1992

[54] PUTTING TRAINING DEVICE

[76] Inventor: Neil J. Hodgkiss, 11 Quicksand Lane, Aldridge, West Midlands WS9 0B0, United Kingdom

[21] Appl. No.: 775,743

[22] Filed: Oct. 15, 1991

[30] Foreign Application Priority Data

Dec. 7, 1990 [GB] United Kingdom ..... 9026632

[51] Int. Cl.[5] ..... A63B 69/36

[52] U.S. Cl. ..... 273/186.2; 273/192; 273/194 R; 273/187.2

[58] Field of Search ..... 273/192, 191 B, 183 B, 273/186 A, 186 C, 191 R, 191 A, 194 R, 81 D, 163 A

[56] References Cited

U.S. PATENT DOCUMENTS

| | | | |
|---|---|---|---|
| 3,595,583 | 7/1971 | Oppenheimer | 273/191 B |
| 4,422,643 | 12/1983 | Cushing | 273/183 B |
| 4,582,325 | 4/1986 | Yuhara | 273/183 B X |
| 4,595,204 | 6/1986 | Patterson | 273/186 A |
| 4,880,240 | 11/1989 | Lewis | 273/183 B X |

*Primary Examiner*—George J. Marlo
*Attorney, Agent, or Firm*—Neil F. Markva

[57] ABSTRACT

A putting aid device of generally T-shape having a stem the lower end of which is securable to the handle end portion of the shaft of a golf club, and having a cross-piece which abuts a user's chest so that end portions extend behind a user's arms, whereby to promote the user maintaining a good putting stance and action by maintaining a constant geometrical configuration of the head, hands, arms and shoulders as indicated by the triangle.

15 Claims, 5 Drawing Sheets

PUTTING TRAINING DEVICE

FIELD OF THE INVENTION

This invention concerns devices for use by golfers when putting or training to putt.

BACKGROUND OF THE INVENTION

It is known that the performance of some golfers can be improved by training them to control the manner in which they move a golf club to strike a ball, i.e. make a "stroke", and/or to adopt a particular stance when making a stroke. Such training is often provided, by a person skilled in the art, on a personal basis, and is usually expensive.

Various kinds of mechanical and electronic devices have been proposed to aid a golfer's attempts to make driving and other forceful strokes, or to indicate the results of such strokes, but such devices are of no use in training a golfer to make the accurately controlled gentle strokes required for putting a ball; and thus many golfers face the problems of cost and availability of skilled personal tuition when attempting to improve their putting.

An object of the invention is to enable such problems to be reduced by providing a training aid.

SUMMARY OF THE INVENTION

According to the present invention there is provided a device which is attachable to or is provided on a golf club; and which is characterized in that it comprises a chest abutment, for engaging a user's chest, a stem extending downwards from the chest abutment and connecting means at the lower end of the stem for releasably securing the stem to a shaft of a golf club.

The connecting means may comprise an insert, which is insertable into an upper end portion of the shaft and is securable, e.g. expandable, therein to secure the stem to the shaft; or may comprise a clamp arrangement to grip a portion of the shaft, below a club handle on the shaft, so that a lower part of the stem serves as bridging means which is located to extend alongside but spaced apart from said handle.

However, the connecting means preferably comprises a bridge member extending between a shaft clamp and a handle-end locator; and the stem is preferably releasably or adjustably connected to the bridge member adjacent to the handle-end locator.

The device may be integrated into a golf club, to form a training club, and according to the present invention there is provided a putting club device comprising a head at one end of a shaft and a handle on the shaft; and characterised in that the shaft is provided with a stem which connects the shaft with a chest abutment extending transversely of the stem.

The geometrical interrelationship between the shaft and the chest abutment is preferably adjustable both linearly and angularly, and such adjustability may, for example, be provided by the connecting means and/or by a connection between the stem and the chest abutment.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
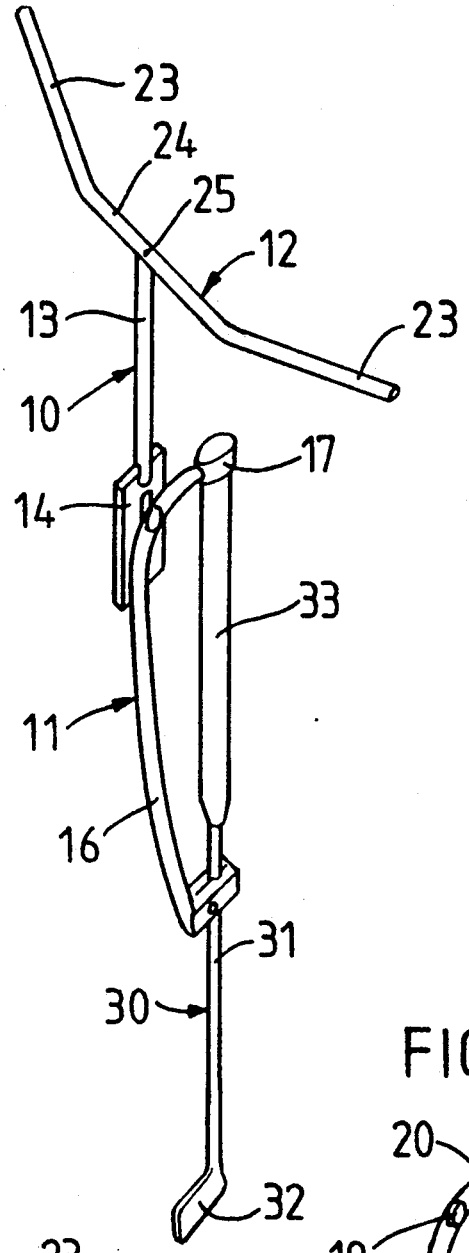
FIG. 1 is a perspective view of a first embodiment device of the invention attached to a putter or putting club.
Figure 2:
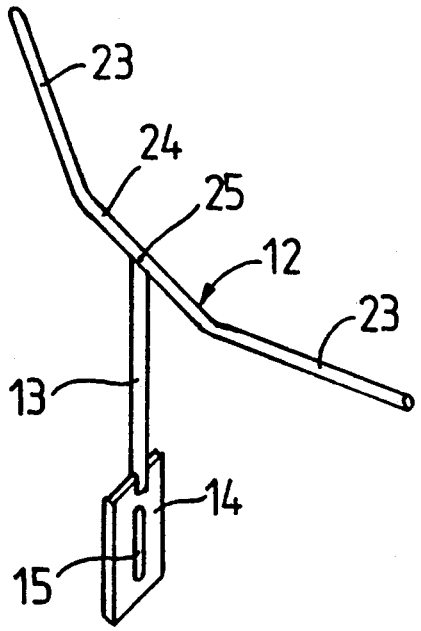
FIGS. 2 and 3 are perspective views of two parts of the device.
Figure 3:
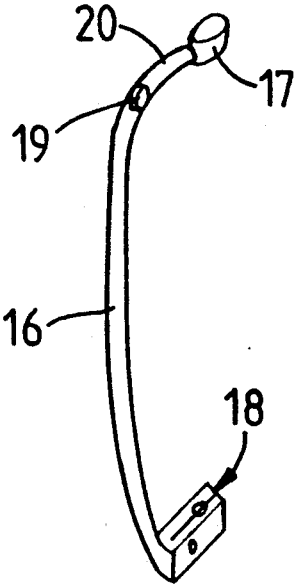
Figure 4:
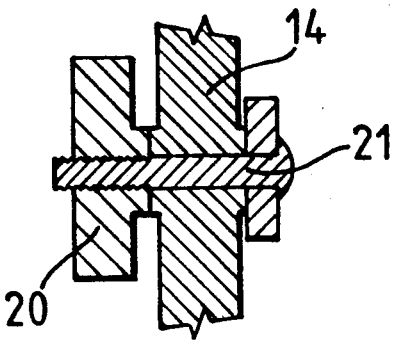
FIGS. 4 and 5 are sectional diagrams of a connection between said parts, and of a shaft clamp of the device.
Figure 5:
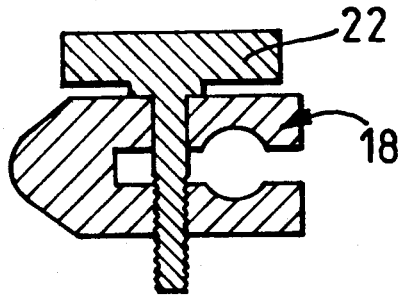

Referring to FIGS. 1 to 5 the first embodiment of the device primarily comprises an upper part 10 (FIGURE 2) and a lower part 11 (FIG. 3) which serves as connecting means for connecting the upper part 10 to a golf club such as a putter 30. The upper part 10 includes a chest abutment 12 about two feet wide which extends transversely of and is carried by an upper end of a stem 13 having a lower end portion 14 in which an elongate slot 15 is provided. The lower part 11 includes a bridge 16 having a handle end locator 17 such as a cup or cap at its upper end and a shaft clamp 18 at its lower end. An aperture or socket 19 is provided in an upper portion 20 of the bridge 16 to receive a fastener 21 (FIG. 4) for securing the portions 14 and 20 together as shown in FIG. 4. A further fastener 22 (FIG. 5) is employed to close the clamp 18 about the shaft 31 of the putter 30.

The putter 30 includes a head 32 at the bottom end of the shaft and a handle 33 around an upper end portion of the shaft 31.

Figure 8:
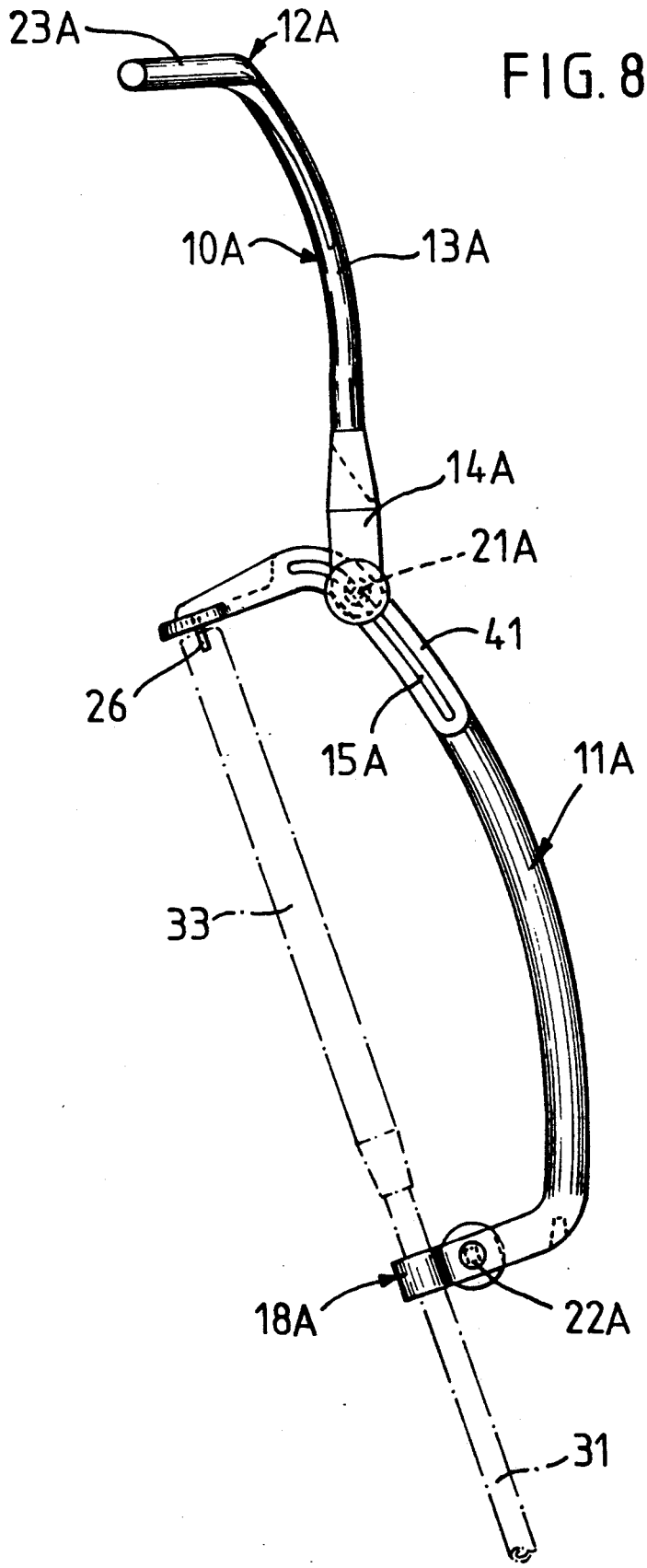
FIG. 8 shows a second embodiment of the device in side elevation.
Figure 11:
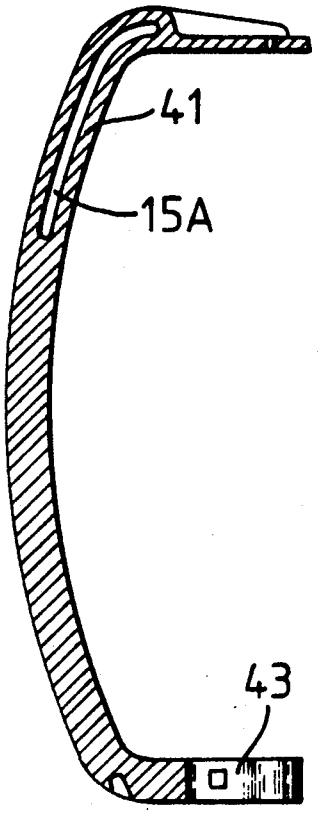
FIG. 11 shows a section on the line XI-XI in FIG. 10 of one of the parts.
Figure 10:
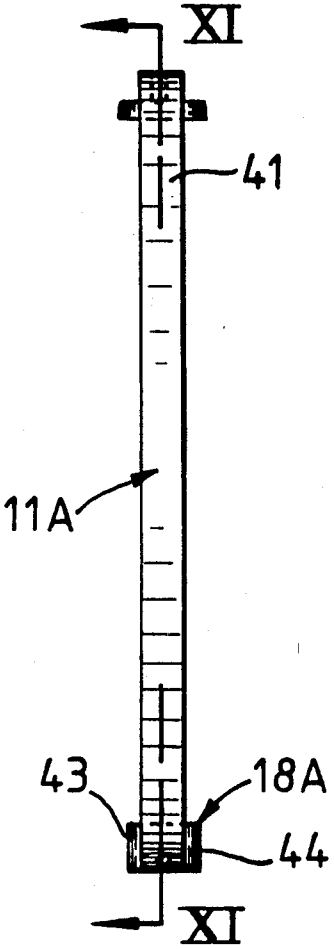
FIGS. 9 and 10 shows plastic moulded parts of the second embodiment of the device in front elevation.
Figure 9:
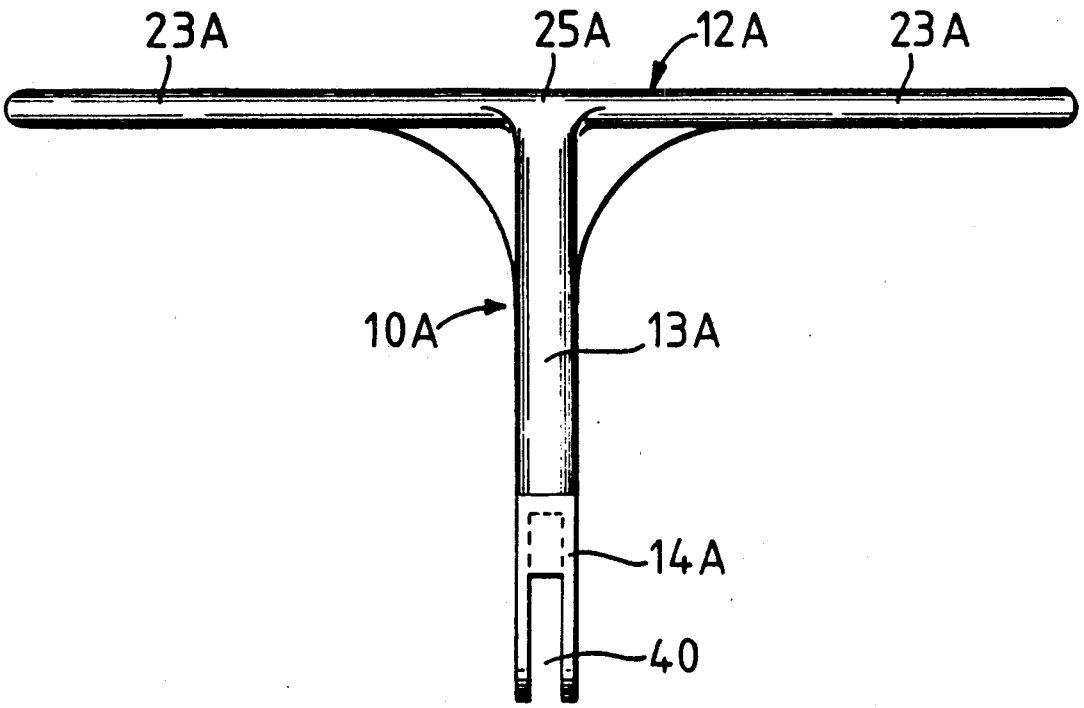

The cap 17 may have a central spike or peg which projects downwards into an axial opening in the upper end of the handle or shaft, such as the spike or peg 26 in the second embodiment (FIG. 8).

The chest abutment 12 is horizontally arched so that bent back end portions 23 thereof are inclined to a median portion 24 which is secured to or integral with the upper end of the stem 13. Said portions 23 serve as shoulder guide means for the user's shoulders as hereinafter described.

In use, the device is attached to the club, and the fastener is tightened when (as diagrammed in FIG. 6) the relative positions of the portions 14 and 20 have been adjusted to give a preferred spacing between the center 25 of the chest abutment 12 and the handle 33 and a preferred angular relationship between the stem 13 and the shaft 31, whereby to determine the geometrical relationship between the handle 33, club head 32 and center 25 to guide the user into a preferred stance or posture and mode of swinging the club.

Figure 6:
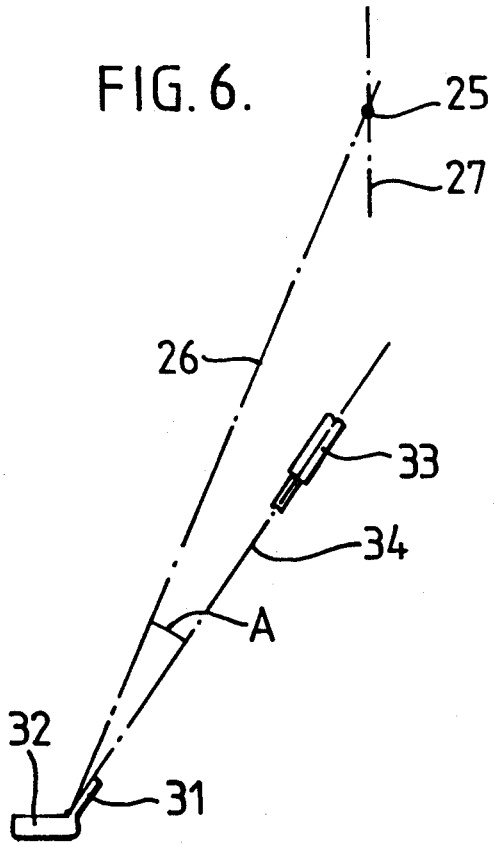
FIGS. 6 and 7 are geometric diagrams, not to scale or proportion or angular relationship, of the relationship between the device and a putting club, and the relationship thereof to a user.
Figure 7:
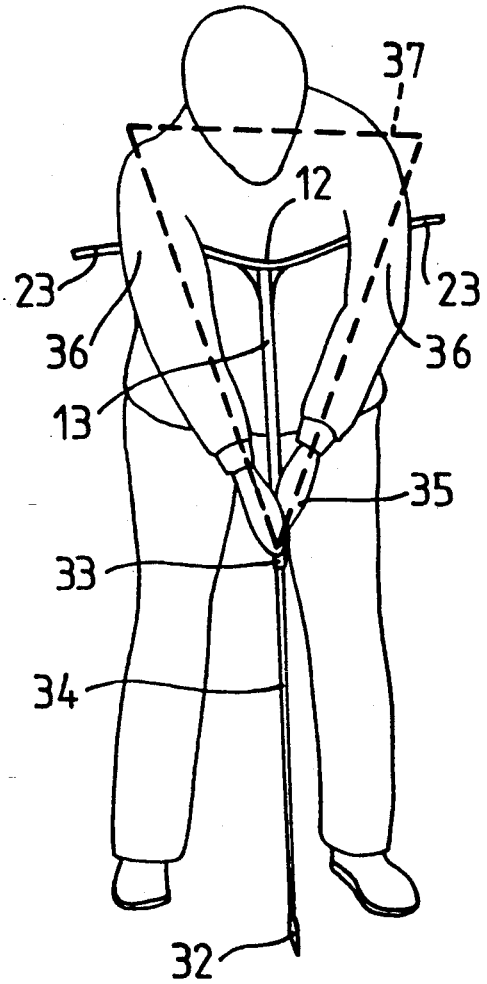

In particular, referring to FIG. 6, and FIG. 7 from which the part 11 is omitted for clarity, the device serves to determine the angle A between the axis or median axis 34 of the shaft 31 and a line 26 between the center 25 and the bottom end of the shaft 31, as well as the distance between the handle 33 and the center 25;

and as a result determines the position of the user's hands 35 and the front plane 27 of the user's chest when the handle is grasped while the abutment 12 is in contact with the chest so that the bent back end portions 23 extend alongside or in contact with parts of the sides of the user's chest adjacent to the user's armpits, and so that the user's arms 36 are caused to extend in front of said end portions when the handle is gripped, whereby to ensure that the user's shoulders are guided by said portions 23. The overall result is that the user's arms, hands and shoulders are guided to maintain a constant triangular relationship as indicated by the triangle 37, of which one side is bisected by the user's sight line to the club head 32.

As a further consequence, the end portions 23 serve to give the user a tactile indication as to when the hands are centralized or moved transversely relative to the user's bodly, and to inhibit turning of the club head relative to said plane 27.

The device is intended to enable and guide the user to putt by moving the club, torso, shoulders, arms and hands in steady unison by movement thereof about the user's waist (or waist and hips), whereby to enable the user to control accurately the strength (velocity) and direction of the putting stroke, and to inhibit variations caused by a multiplicity of control errors such as twisting of the wrists, dropping one shoulder, turning one arm out or irregular movements of the arm and/or shoulder muscles.

The second embodiment shown in FIGS. 8 to 11 is functionally equivalent to the first embodiment so that the foregoing description relating to FIGS. 6 and 7 applies equally to the second embodiment; and in the drawings those parts of the device which are equivalent to parts of the first embodiment are indicated by the same reference numbers with a suffix A and are generally as described with reference to the first embodiment. The second embodiment differs from the first embodiment primarily in that the upper part 10A is molded so that the stem 13A is bowed and is bifurcated at its lower end 14A to provide a socket 40 for part 41 of the lower part 11A; the lower part 11A is molded to include an arched form of the slot 15A in the part 41 for adjustable clamping of the part 41 in the socket 40 by the fastener 21A; and the clamp 18A is split so that part 43 is integral with the lower part 11A and a further part 44 is held in position by the fastener 22A.

Figure 12:
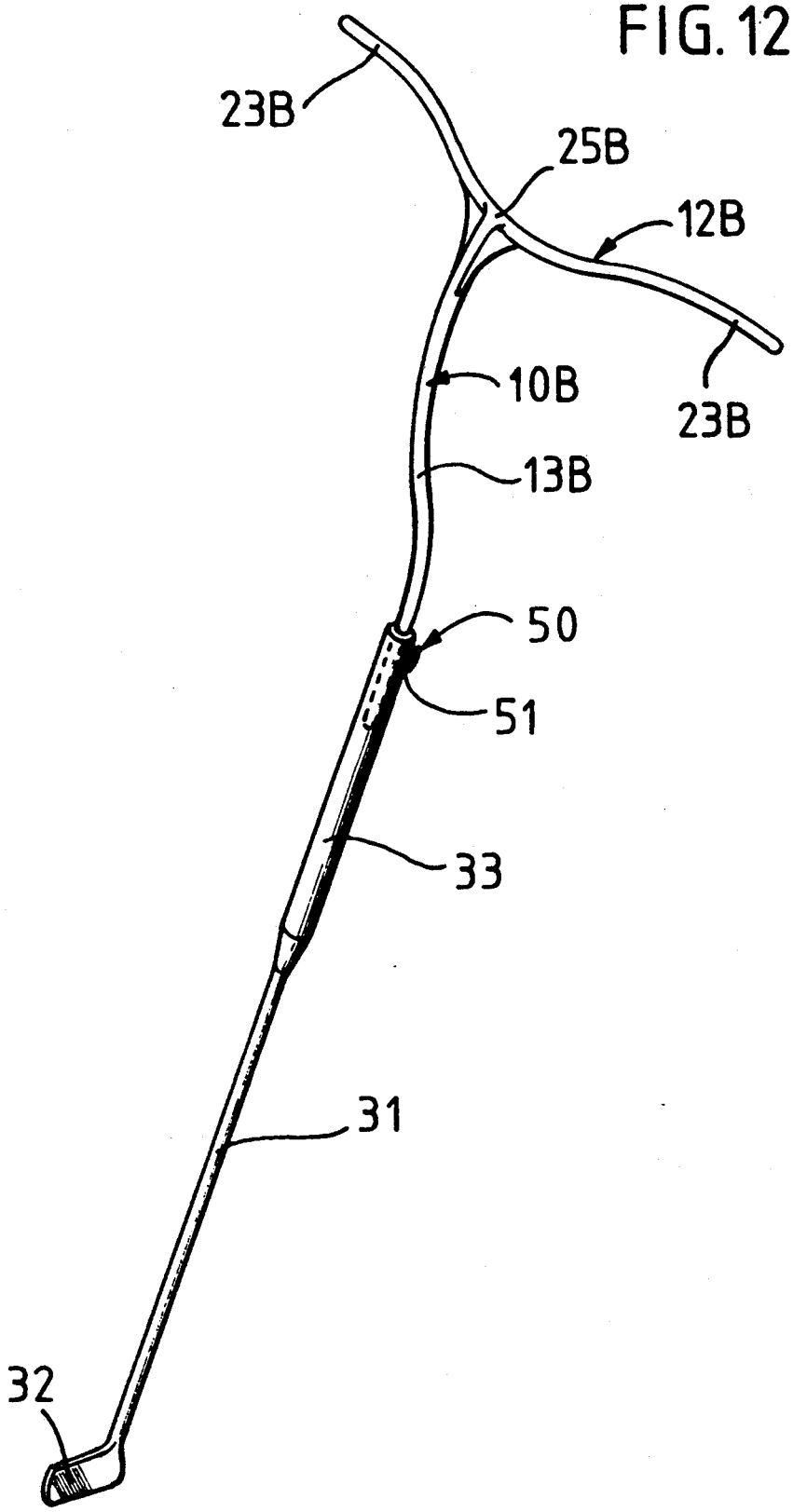
FIG. 12 shows a perspective view of a third embodiment of the device.

The description relating to FIGS. 6 and 7 applies equally to the third embodiment as shown in FIG. 3 without part 11 and FIG. 7 is a reasonably graphic illustration of this embodiment which is shown in more detail in FIG. 12, in which parts equivalent to parts of the first and second embodiment are indicated by the same reference numbers with the suffix B.

The third embodiment differs from the previous embodiments primarily in that it has no second part 11 or 11A, and the connecting means 50 comprises a fastener 51 to secure the lower end portion of the stem 13B of the upper part 10B in the upper end portion of the shaft 31 concentric with the handle 33.

It will be appreciated that the detailed construction of the device may be varied considerably from the examples disclosed in the drawings, and the device may be of any form which can be secured reliably, or incorporated into, a putting club to give a predetermined, or preferably adjustably presettable, geometric relationship between the club head, club handle and a chest abutment, and the invention accordingly includes within its scope any such device or club incorporating or provided with such a device.

What I claim is:

1. An apparatus for assisting a golfer while putting, said apparatus comprising in combination:

a) a putter including a head, a handle, and a shaft connecting the head to the handle; and b) a chest abutment means including means for mounting said chest abutment means to said putter to project upwardly from said handle;

c) said chest abutment means including a stem portion connected at one end thereof to said putter and at the other end thereof shoulder guide means extending transversely to said stem portion;

d) said shoulder guide means including opposing outer end portions having a structural configuration effective to extend behind the arms and under the armpits of the user to physically guide the user's shoulders; and e) said chest abutment means being effective to maintain a constant geometrical configuration of the user's chest, shoulders, hands, and arms while putting.

2. An apparatus as defined in claim 1 wherein said mounting means includes clamp means releasably embracing the shaft at a location below the handle.

3. An apparatus as defined in claim 1 wherein said chest abutment means includes handle bridging means, clamp means secured to a lower end of the bridging means and releasably embracing the shaft below the handle, and locator means secured to an upper portion of the bridging means and engaged to the shaft portion.

4. An apparatus as defined in claim 3 wherein said bridging means is adjustably connected to the stem portion to permit adjustment to the distance between the chest abutment means and bridging means.

5. An apparatus as defined in claim 3 wherein said bridging means is adjustably connected to the stem portion to permit adjustment of the angle between the stem portion and the bridging means.

6. An apparatus as defined in claim 1 wherein said mounting means includes connecting means that is integral with an upper section of the shaft and a lower section of the stem portion.

7. An apparatus for assisting a golfer while putting with a golf club having a head, a handle, and a shaft connecting the head to the handle, said apparatus comprising:

a chest abutment means including means for mounting said chest abutment means to a golf club to project upwardly from said handle;

b) said chest abutment means includes a stem portion at one end thereof and a shoulder guide means at the other end thereof extending transversely to said stem portion;

c) said shoulder guide means including opposing outer end portions having a structural configuration effective to extend behind the arms and under the armpits of the user to physically guide the user's shoulders when said stem portion is connected to said golf club; and d) said chest abutment means being effective to maintain a constant geometrical configuration of the user's chest, shoulders, hands, and arms while putting.

8. An apparatus as defined in claim 7 wherein said mounting means includes a bridge member extending between clamp means and handle-end locator means.

9. An apparatus as defined in claim 8 wherein said stem portion has a lower end adjustably connected to the bridge member adjacent to the handle-end locator means to permit angular displacement of the relative positions of the stem portion and bridge member.

10. An apparatus as defined in claim 7 wherein said chest abutment means includes an elongate member extending transversely across and centrally attached to the top of the stem portion, said elongate member including bent end portions which extend at least partially at the sides of the user's chest to the user's armpits.

11. An apparatus as defined in claim 7 wherein said mounting means includes clamp means adapted to releasably embrace the shaft at a location below the handle.

12. An apparatus as defined in claim 7 wherein said chest abutment means includes handle bridging means, clamp means secured to a lower end of the bridging means and adapted to releasably embrace the shaft below the handle, and locator means secured to an upper portion of the bridging mean and adapted to be engaged to the shaft portion.

13. An apparatus as defined in claim 12 wherein said bridging means is adjsutably connected to the stem portion to permit adjustment to the distance between the chest abutment means and bridging means.

14. An apparatus as defined in claim 12 wherein said bridging means is adjustably connected to the stem portion to permit adjustment of the angle between the stem portion and the bridging means.

15. An apparatus as defined in claim 7 wherein said mounting means includes connecting means that is integral with an upper section of the shaft and a lower section of the stem portion.

* * * * *